US007086332B2

(12) United States Patent
Wegter

(10) Patent No.: US 7,086,332 B2
(45) Date of Patent: Aug. 8, 2006

(54) PUNCHING DEVICE

(75) Inventor: Bernd Wegter, Nordhorn (DE)

(73) Assignee: MAN Roland Druchmaschinen AG, Offenbach/Main (DE)

( * ) Notice: Subject to any disclaimer, the term of this patent is extended or adjusted under 35 U.S.C. 154(b) by 74 days.

(21) Appl. No.: 10/416,690

(22) PCT Filed: Oct. 20, 2001

(86) PCT No.: PCT/EP01/12150

§ 371 (c)(1),
(2), (4) Date: Sep. 2, 2003

(87) PCT Pub. No.: WO02/38367

PCT Pub. Date: May 16, 2002

(65) Prior Publication Data

US 2004/0016353 A1 Jan. 29, 2004

(30) Foreign Application Priority Data

Nov. 10, 2000 (DE) ..... 200 19 097 U

(51) Int. Cl.
*B41F 27/00* (2006.01)
*B26D 7/26* (2006.01)

(52) U.S. Cl. ..... 101/389.1; 101/375; 83/698.21; 72/446; 72/462

(58) Field of Classification Search ..... 101/389.1, 101/375, 405, 226, 383; 83/698.21, 698.42, 83/619; 72/446, 462
See application file for complete search history.

(56) References Cited

U.S. PATENT DOCUMENTS 2,229,133 A * 1/1941 Sands ..... 101/383
3,670,646 A * 6/1972 Welch, Jr. ..... 101/389.1
4,072,920 A * 2/1978 Wright ..... 335/285
4,453,468 A * 6/1984 Shenoha ..... 101/389.1
4,730,529 A * 3/1988 Schroder ..... 83/425.4
4,972,747 A * 11/1990 Boyd et al. ..... 83/678
5,136,945 A * 8/1992 Kawazoe ..... 101/389.1
5,313,885 A * 5/1994 Winston ..... 101/405
5,832,831 A * 11/1998 Boyle et al. ..... 101/375
5,857,409 A * 1/1999 Derrickson ..... 101/38.1
5,865,433 A * 2/1999 Morrissette ..... 271/276
6,152,035 A * 11/2000 Scholtz et al. ..... 101/389.1
6,267,053 B1 * 7/2001 Miske et al. ..... 101/226
6,324,977 B1 * 12/2001 Hadden ..... 101/405
6,341,557 B1 * 1/2002 Hutchison et al. ..... 101/389.1
6,651,539 B1 * 11/2003 Eicher et al. ..... 83/698.42

FOREIGN PATENT DOCUMENTS

DE 2258329 A * 6/1974

* cited by examiner

*Primary Examiner*—Ren Yan
(74) *Attorney, Agent, or Firm*—Leydig, Voit & Mayer, Ltd

(57) ABSTRACT

The invention pertains to a device for processing printed matter, in particular, for punching, perforating, grooving, embossing, imprinting, spot-coating or the like. In order to simplify the attachment of the processing tools required for the additional processing, the invention proposes that a carrier be attached to a rotating or flat working element 8. The processing tools can be attached to this carrier such that they can be easily removed again. The size of the processing tools 3 that, for example, are provided with punching lines 4 can be limited to the processing area. The processing tools can be removed and also easily repositioned at any time. A magnetic attachment proved particularly advantageous. For this purpose, the carrier may be realized in the form of a magnetic foil 6.

5 Claims, 3 Drawing Sheets

Fig. 2
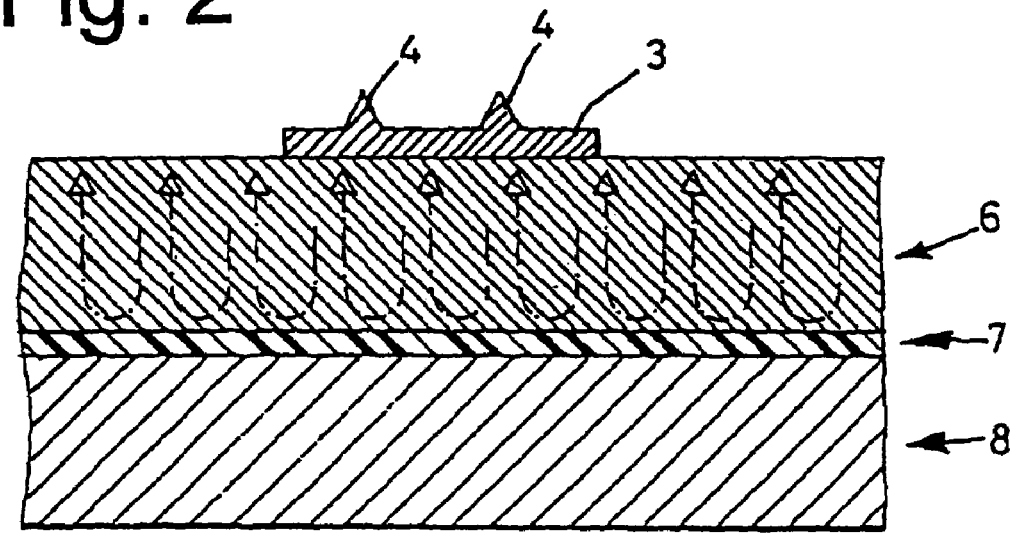
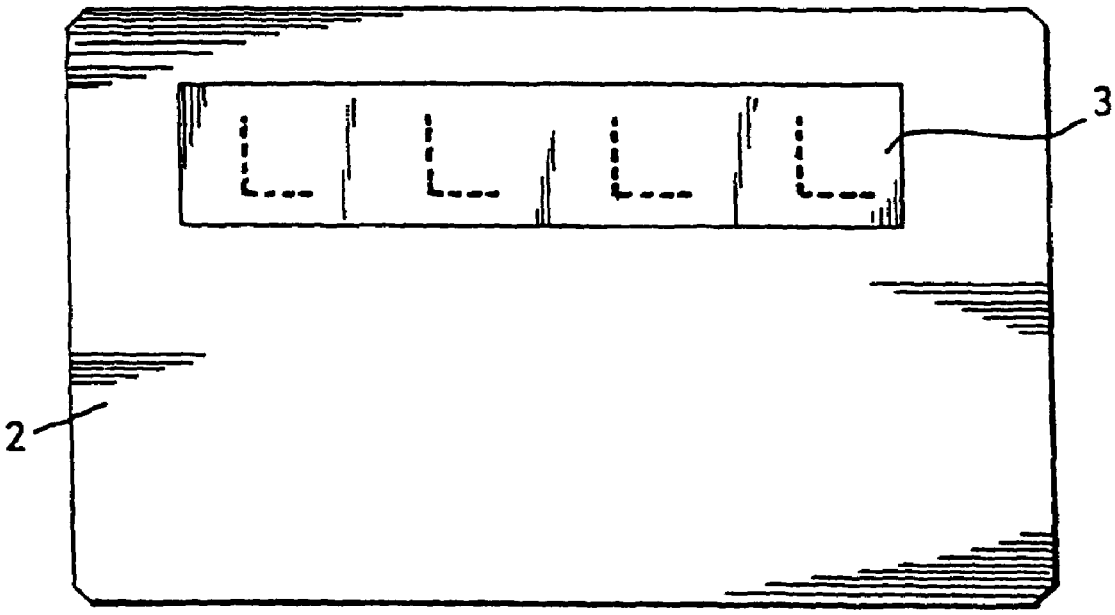
Fig. 3

PUNCHING DEVICE

FIELD OF THE INVENTION

The present invention relates generally to a device for punching, perforating, grooving or embossing paper materials.

BACKGROUND OF THE INVENTION

In addition to pure punch presses with oscillating tools that are known, e.g., from the sheet metal processing industry, punching devices for the paper processing industry also exist. These punching devices exclusively use punching tools. However, it is also known to provide rollers or cylinders that are intended for printing purposes and which are referred to, for example, as printing cylinders, form cylinders or rubber cylinders with processing tools that extend around these cylinders in a curved fashion. This makes it possible to inexpensively carry out punching, perforating, grooving or embossing processes on the printed or yet-to-be printed paper or cardboard sheets during the printing process, i.e., with the working systems that are in any case provided in a printing plant.

Analogous to printing blankets that are placed around the rubber cylinders and clamped thereon, the aforementioned processing tools are also configured such that they can be clamped onto the periphery of rubber cylinders. Alternatively, it is possible to bond the processing tools onto a cylinder of a printing station in a printing machine, in particular, for larger batch sizes to be punched.

In both instances, the use of processing tools of comparatively large formats causes various problems. For example, the manufacture of these processing tools is very complicated, and consequently expensive, if the complete format of a punching sheet must be etched down except for the punching lines. Such clamped, large-format punching sheets are also very difficult to position, so that corrections in order to adapt the punching pattern to the sheets to be processed after the punching sheet is initially clamped in position result in significant expenditures. Expenditures for repositioning and correcting the position of the punching sheets are even greater when the punching sheets are bonded in position.

In addition to punching processes, groove-forming, perforating or embossing processes are also carried out in printing machines as part of what is referred to as in-line manufacture of printed sheets. These processes represent special instances of punching processes and were, until now, carried out with comparable working mechanisms.

In an in-line manufacturing process, imprinting or coating means are also used in printing machines for realizing additional processing steps in printing machines. In these instances, the alignment of the corresponding tools into the required working position is a known problem that can only be solved with significant mechanical expenditures.

In other known processing machines, flat as well as flat and cylindrical working surfaces are arranged opposite one another. In machines of this type which are also used for processing printed matter and packaging materials, the attachment of the processing tools also represents a known problem. The attachment of the processing tools on flat or curved surfaces does not differ in principle from the purely rotative processing method in this case. For example, the above-described problems also arise in a rotative processing tool that cooperates with a flat counter surface. Only the special requirements that result from the curvature are eliminated with flat processing tools. The relationship between the high expenditure for a full-surface processing tool and, if applicable, a small actual working surface is identical to the previously described circumstances.

BRIEF SUMMARY OF THE INVENTION

In view of the foregoing, the invention is based on the object of improving a device of this type in such a way that it can also be inexpensively used for small lot sizes and not only allows a rapid and simple handling of the processing tools (e.g., punching sheets or printing forms) during their attachment and removal, but also, during any required repositioning of the processing tool.

To this end, the invention proposes using processing tools that do not extend completely around the cylinder periphery In particular, small and inexpensive processing tools (e.g., punching sheets) can be used which are fixed by adhesion to the cylinder and whose position can also be easily corrected after they are fixed on the cylinder. Surprisingly, a separable adhesive connection suffices for fixing the processing tools in position in order to carry out punching processes in the paper and cardboard processing industry as well as protecting the processing tools from shifting on the cylinder.

Here, the term "adhesion" refers to a connection between the processing tool and the cylinder that makes it possible to fix the processing tool on the cylinder without additional fastening means, e.g., screws, strong adhesives or the like, and to subsequently remove the processing tool from the cylinder without the assistance of tools, solvents or the like. Such an "adhesion" is, for example, known from the field of office administration in the form of so-called "adhesive notes." Besides a weak adhesive force, the desired adhesion may also be achieved in other ways. For example, since punching sheets frequently consist of a ferromagnetic sheet metal, it is possible to provide the cylinder with magnets or a magnetic foil.

The adhesive arrangement may either be located on the cylinder, for example, in the form of a weak adhesive or magnetic coating, or on the processing tools, for example, in the form of a weak adhesive or magnetic coating.

However, it would also be conceivable to use an intermediate element in the form of a carrier between the cylinder and the processing tool. For example, this carrier can be configured similar to a printing blanket such that it can be conventionally clamped onto existing cylinders. This carrier makes it possible to adhesively fix processing tools. Consequently, it is possible to reliably prevent undesired changes to the surface of the cylinder, e.g., scrapes or soiling caused by the handling of the processing tools. Instead, such surface changes only occur on the carrier, which can be replaced relatively inexpensively.

The carrier may merely serve to protect the cylinder and for the fixing of processing tools prepared with an adhesive. Alternatively, the carrier may also be realized with the adhesive.

Such a carrier may consist of a textile material that has a weak adhesive or magnetic effect on its outer surface; for example, the carrier can be coated with a weakly adhesive layer or contain magnetic strips that are woven into the textile material. Alternately, the carrier may be provided with a magnetic foil or individual magnets on its surface.

In instances in which the punching sheets can be magnetically fixed on the carrier, the carrier may contain a ferromagnetic layer or a substructure of a ferromagnetic sheet metal, where the carrier may also contain a sheet metal foil that can be very easily bent to conform to the cylinder.

This results in a so-called reversing effect that intensifies the magnetic force on the surface of the magnet that opposes the substructure such that a reliable retention of the punching sheets is also achieved if a comparatively thin and weak magnetic layer is used.

When using magnetic foils for the carrier of processing tools, it is desirable to use magnetic foils with a particularly advantageous pole pitch. Magnetic foils of this type are generally known. A particularly advantageous adhesiveness is achieved, for example, when using magnetic foils with a thickness of approximately 1 mm. In this case, an optimized relation is achieved between the magnetic force that can be realized and the assignment of the processing tool to the carrier with respect to the kinematics and the mechanics of the processing method, where said assignment is changed due to the thickness of the magnetic foil.

It is advantageous if the surface of either the cylinder or the carrier is provided with auxiliary lines, e.g., like those of graph paper from the field of technical drawing. This makes it possible to achieve a particularly simple and correct positioning of the processing tools, simplifying the checking and correction of the position of the processing tool.

If a carrier is provided for the processing tools, the carrier may be fixed on the cylinder by means of conventional clamping rails that are used in the printing industry for printing blankets. The connection between a magnetic foil or a weakly adhesive layer and the substructure, i.e., a plate or a foil consisting of textile, metallic or plastic materials, can be realized by means of bonding, fusion, or a pin connection in order to ensure that the adhesive layer is reliably fixed on this substructure of the carrier.

If the carrier has corresponding stability, it is not only possible to use the carrier on cylindrical working systems, but also on flat working systems, e.g., flatbed working machines. In this case, the adhesiveness of the carrier on ferromagnetic substructures can be advantageously used. The carrier essentially holds itself and the processing tools on the working surface of the working machine. However, this does not eliminate the need to clamp the carrier in position because the exact position or positioning of the processing tool including the carrier must be ensured.

Punching, perforating, groove-forming, embossing, imprinting or spot-coating plates may be considered as processing tools. The processing tools may also have a linear form or any other form that is adapted to the desired working area.

A particular advantage of the device according to the invention is that arbitrary processing tools can be very easily exchanged in the printing machines without having to remove the carrier for adhesively fixing the processing tools from the given machine. It is even possible to reposition the processing tool within the printing.

BRIEF DESCRIPTION OF THE DRAWINGS

FIG. 2 is a partial side sectional view of the carrier and processing tool of FIG. 1.

FIG. 3 is a top plan view of the carrier and processing tool of FIG. 1.

DETAILED DESCRIPTION OF THE INVENTION

Figure 1A:
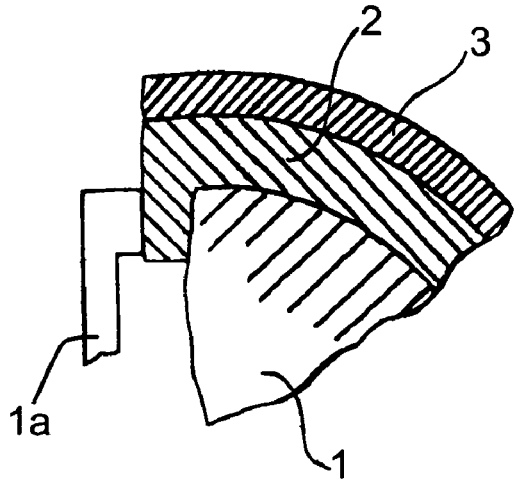
FIG. 1A is an enlarged fragmentary section showing the carrier and processing tool secured to the cylinder by a conventional clamping rail.
Figure 1:
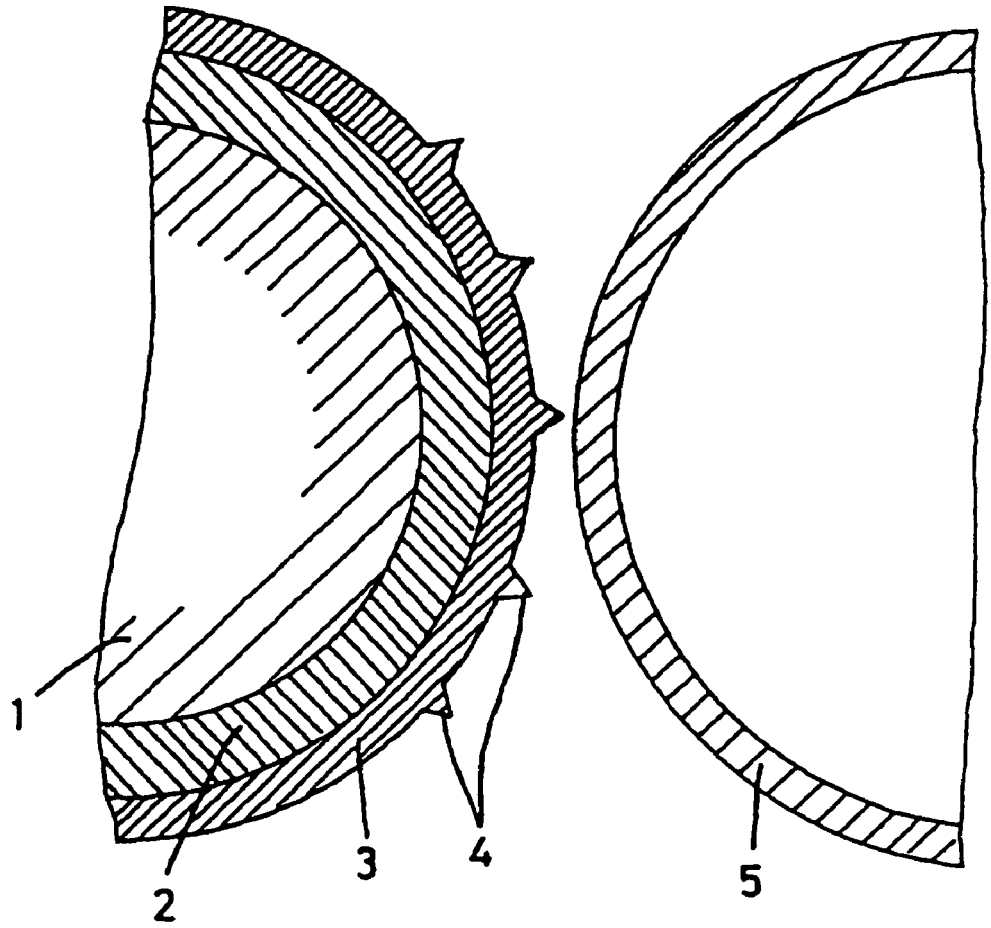
FIG. 1 is a partial schematic side view of an illustrative cylinder and counter-pressure cylinder of a printing machine showing the cylinder equipped with an exemplary carrier and processing tool, in this case a punching sheet, in accordance with the invention.

In FIG. 1, the reference symbol 1 identifies a roller-shaped cylinder that usually is already provided in a printing machine, particularly an offset printing machine. A carrier 2 is clamped onto the cylinder 1 and secured in a channel of the cylinder 1 by a conventional clamping rail in the same say that printing blankets are clamped to rubber cylinders. The carrier 2 contains a punching sheet 3 that is provided with elevations 4, with several continuously arranged elevations 4 of this type forming so-called punching lines.

A paper or cardboard sheet to be punched can be inserted between the cylinder 1 and a counter-pressure cylinder 5, with the peaks of the elevations 4 extending into the vicinity of the surface of the counter-pressure cylinder 5 such that the paper or cardboard sheet inserted between the cylinder 1 and the counter-pressure cylinder 5 is cut or perforated at the corresponding locations.

FIG. 2 shows the design of the carrier 2; the punching sheet 3 is held by a magnetic foil 6. This magnetic foil 6 forms the upper or outer layer of the carrier 2 and ensures the required adhesiveness. The magnetic foil is bonded onto a substructure 8 of the carrier 2 by means of an adhesive layer 7 The substructure 8 consists of a ferromagnetic layer in the form of a steel sheet or a steel foil. The steel sheet or the steel foil, as well as the magnetic foil 6, can be bent in such a way that the entire carrier 2 can be placed around the cylinder 1 and fixed to the cylinder 1 by conventional means. This may be realized, for example, with the aid of corresponding clamping rails.

The ferromagnetic substructure 8 of the carrier 2 causes a reversing effect within the magnetic foil 6 which is indicated by the curved arrows in FIG. 2. This means that a particularly strong adhesive force is generated on the outer surface of the magnetic foil 6, and that the punching sheets 3 can quite reliably be fixed in position. In addition, the punching sheet 3 can be very easily removed from the carrier 2 because it is not rigidly connected to the carrier 2, e.g., by means of bonding or a screw connection. On the contrary, the punching sheet is merely adhered to the carrier 2. This means that the punching sheet 3 can be repositioned simply, continuously and precisely in order to correct its position. It is also possible to arrange the punching sheets 3 in a different manner or to use differently designed punching sheets 3 on the cylinder 1. This permits an inexpensive, fast and flexible retooling process such that smaller lot sizes can also be economically processed.

FIG. 3 shows a top view of a carrier 2 with an adhered punching sheet 3. One can clearly ascertain that the dimensions of the punching sheet 3 can be made very small in relation to the size of the carrier 2. Thus, the complicated processing steps associated with manufacturing the punching sheet 3, as well as the manufacturing costs, can be significantly reduced in comparison with a conventional punching sheet that extends over the entire periphery of the cylinder and is approximately the same size as the carrier 2.

In contrast, the invention includes a reusable carrier that is arranged over the entire periphery of the cylinder such that the corresponding processing tools only need be provided in the areas where punching lines are required. These processing tools may have a correspondingly small and inexpensive design. FIG. 3 shows such a punching sheet 3 with several punching lines each having a L-shaped configuration.

A punching process is only one possible processing step for the in-line manufacture of paper or cardboard products in a printing machine. It is also possible to use perforating, groove-forming or embossing tools instead of punching tools. Processing tools of this type generally cover only a small surface. For example, perforating or groove-forming tools usually have a linear configuration. Embossing tools have a relatively small size and may be limited to a local embossing pattern, e.g., a coat of arms. Most of these processing tools are manufactured from ferromagnetic material, as is also the case with punching tools. Therefore, they can be adhesively and separably attached to a carrier formed from a metal foil directly, i.e., without an auxiliary mechanism or system. Processing tools of this type which are flexible may also be provided with a weakly adhesive coating on the back side and attached adhesively and separably to the carrier in this way. Conversely, the carrier may be provided with a surface that is weakly adhesive compared with the back side of the processing tools. The attachment and alignment of the corresponding processing tools can be performed very easily, also within the particular working machine.

It is also possible to carry out imprinting or special coating processes at certain locations within a printing machine. One example of such a process is so-called spot-coating. In a spot-coating process, an application device for coating fluids or printing inks is assigned to the cylinder on which the processing tools are mounted. This application device conventionally cooperates with the respective surface of a processing tool on the corresponding cylinder. The surface of the processing tool may be in the form of a rubber blanket, a printing plate or a plastic layer on a foil-like carrier layer. In this case, the processing tool may also be provided with a compressible layer of an elastic, cellular or porous material between the carrier layer and the surface. This intermediate layer may have damping properties relative to the stresses occurring during the process. As described above, corresponding processing tools for applying localized printing patterns, individual print images or surface coatings of limited surface area may be provided. The back side of the processing tools, in this case, may be realized in a weakly adhesive or ferromagnetic fashion in order to attach the processing tools adhesively and separably. In a ferromagnetic variation, a processing tool for printing or coating processes can be arbitrarily positioned in an easily separable fashion on a carrier or cylinder provided with a magnetic foil. The attachment and the alignment of the corresponding printing or coating tools can also be easily realized within the working machine used.

The described systems and methods for attaching processing tools for processing paper or cardboard products is not limited to cylindrical working elements such as cylinders. These mounting systems and methods may be analogously used in working machines with flat working elements. In these so-called flatbed machines, the working surface, as initially mentioned, is subjected to an oscillating vertical movement relative to the paper or cardboard material to be processed. The processing tools may also be adhesively and separably attached to a carrier with this type of printing machine. The carrier is fixed on the working surface of the working machine in a comparable fashion. However, the carrier is not bent in this case, but rather flatly clamped onto the working surface. The processing tools can also be very easily attached, positioned and removed again without having to exchange the carrier and without risking damage to its surface or the surface of the working element of the working machine. However, the carrier still must be clamped in position because the processing tool including the carrier must be secured in the proper position.

It is possible to use different variations of flat working surfaces. As described above, the flat working surface may be provided on the processing tool or on the counter surface. Thus, there are various production methods that may be used for the above-described processes. Since the processing tool can be used on cylindrical and flat carriers, the following combinations are possible:

cylindrical processing tool with cylindrical counter surface cylindrical processing tool with flat counter surface flat processing tool with cylindrical counter surface or flat processing tools with flat counter surface.

Illustrative devices and arrangements are described above.

It must be noted that the relative movements of the working surface and the counter surface will vary in the above-described combinations. For example, with the combination of a flat surface and a cylindrical surface, the flat surface is moved back and forth in an oscillating fashion and thus brought in contact with the rotating cylindrical counter surface. The work stroke may only take place in one direction such that the sheet material to be processed is inserted on one side and removed on the other side of the working machine.

The device according to the invention consequently allows a wide range of processing options for different applications.

The adhesion of the processing tools on the carrier can be improved by increasing the surface that adheres to the carrier in relation to the working surface. With processing tools having a non-ferromagnetic working surface, in particular, it is possible to provide a thin and, if so required, large-surface substructure of a ferromagnetic material. This arrangement allows sliding transitions between the adhesive surface and the working surface of the processing tool. Consequently, various processing steps, e.g., imprinting or coating steps, can be improved.

Figure 4:
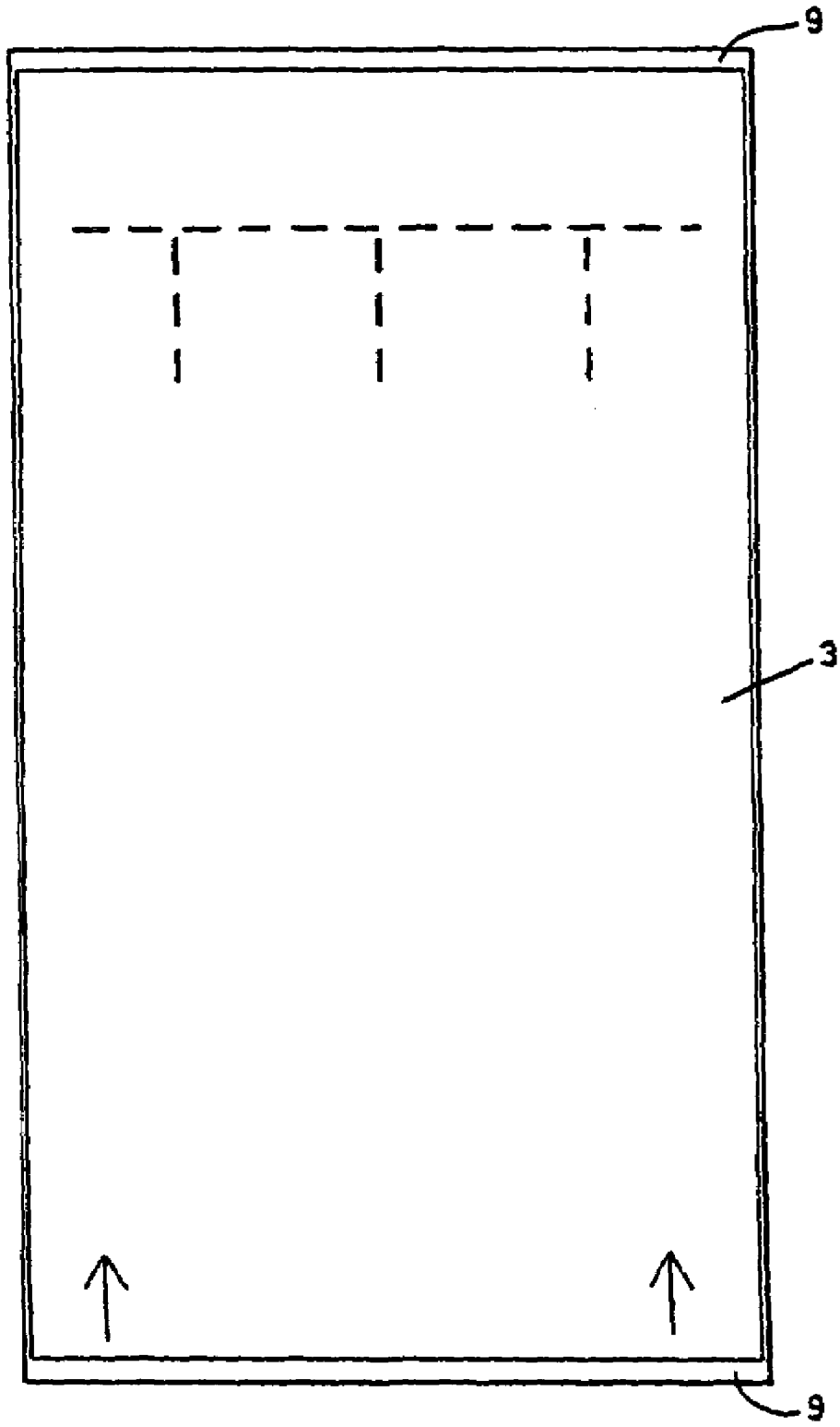
FIG. 4 is a plan view of a conventional punching sheet.

FIG. 4, in contrast, shows a conventional prior art punching sheet 3 with punching lines in an approximately E-shaped configuration. This punching sheet 3 contains clamping rails 9 on both end surfaces. These clamping rails have a conventional configuration and are thus only indicated schematically. In order to produce the punching lines, punching sheets 3 of this type are usually etched down over nearly the entire surface until only the punching lines remain. Thus, the work required increases with the size of the punching sheet 3 and in relation to the actual effective surface area of the punching sheet 3 around the punching lines.

What is claimed is:

1. A device for punching, grooving, perforating, embossing or coating paper materials comprising:

a roller-shaped first cylinder having a working surface and clamping rails;

a second cylinder associated with and arranged opposite the first cylinder;

a magnetic carrier secured on the working surface of the first cylinder by the clamping rails with the carrier covering substantially the entire working surface of the first cylinder;

at least one processing tool for punching, grooving, perforating, embossing or coating a paper material, the processing tool being releaseably connected to the carrier entirely by magnetic attraction without auxiliary fastening means that must be released to permit removal from or adjustable positioning of the processing tool on the carrier, the processing tool having a working surface that faces towards the second cylinder, the processing tool having a footprint that is substantially the same size as the working surface of the processing tool.

2. The device according to claim 1, in which said magnetic carrier comprises a magnetic foil.

3. The device according to claim 2, wherein the carrier includes a substructure of ferromagnetic material which is arranged underneath the magnetic foil.

4. The device according to claim 3, wherein the substructure comprises sheet metal.

5. The device according to claim 1, in which the foot print of said at least one processing tool is substantially smaller in size than the working surface of the first cylinder.

* * * * *